US005427736A

United States Patent [19]

Ritter et al.

[11] Patent Number: 5,427,736

[45] Date of Patent: Jun. 27, 1995

[54] METHOD OF MAKING METAL ALLOY FOILS

[75] Inventors: Ann M. Ritter, Albany; Paul L. Dupree, Scotia; Donald N. Wemple, Jr., Schenectady, all of N.Y.

[73] Assignee: General Electric Company, Schenectady, N.Y.

[21] Appl. No.: 223,345

[22] Filed: Apr. 5, 1994

[51] Int. Cl.[6] ..... B22F 3/14

[52] U.S. Cl. ..... 419/48; 419/49

[58] Field of Search ..... 419/48, 49

[56] References Cited

U.S. PATENT DOCUMENTS

| | | | |
|---|---|---|---|
| 4,380,479 | 4/1983 | Coad | 148/11.5 P |
| 4,640,816 | 2/1987 | Atzmon et al. | 49/24 |
| 4,820,141 | 4/1989 | Shingu et al. | 419/8 |
| 4,917,858 | 4/1990 | Eylon et al. | 419/28 |
| 4,957,421 | 9/1990 | Baldi | 419/8 |
| 5,009,687 | 4/1991 | Kromrey | 65/18.1 |
| 5,010,050 | 4/1991 | Willenweber et al. | 502/301 |
| 5,061,427 | 10/1991 | Hirzel | 264/219 |
| 5,096,518 | 3/1992 | Fujikawa et al. | 156/89 |
| 5,147,086 | 9/1992 | Fujikawa et al. | 228/243 |
| 5,154,882 | 10/1992 | Zick | 419/49 |

OTHER PUBLICATIONS

"News at a Glance"; Advanced Materials & Processes; Feb., 1992; p. 9; col. 1, 2.

"Processing and Properties of Gamma Titanium Aluminide Sheet from PREP Powder"; Powder Metallurgy in Aerospace & Defense Techologies; M. A. Ohls, W. T. Nachtrab and P. R. Roberts; 1991; pp. 289–296.

*Primary Examiner*—Donald P. Walsh
*Assistant Examiner*—Daniel Jenkins
*Attorney, Agent, or Firm*—Edmund P. Anderson; James Magee, Jr.

[57] ABSTRACT

A method for making metal alloy foils directly from metal alloy powder is described. The metal alloy foils are formed by the use of a combination of a means for heating and a means for pressing, such as a hot isostatic press, to densify a metal alloy powder so as to directly form a metal alloy foil. The metal alloy powder is contained within an apparatus which has a near-net shape of a foil, such that the application of heat and pressure will consolidate the metal powder and form the metal alloy foil. This method may be used to make metal foils out of a wide variety of metal alloys, particularly high temperature alloys, such as Ti-base, Ni-base, and B-base and Al-Si alloys. After the step with heating and pressing, the metal alloy foil is removed from the apparatus which is used to contain it, such as by the use of chemical etching or milling. The method also comprises subsequent thermal or mechanical processing of the metal alloy foil in order to improve its properties, such as the use of cold-rolling to enhance the uniformity of the metal alloy foil thickness and/or alter the mechanical properties of the foil.

19 Claims, 4 Drawing Sheets

METHOD OF MAKING METAL ALLOY FOILS

CROSS-REFERENCE TO RELATED APPLICATIONS

The subject application is related to U.S. patent applications Ser. No. 08/223,347, filed Apr. 5, 1994 and Ser. No. 08-194,967, filed Feb. 14, 1994; which are herein incorporated by reference.

FIELD OF THE INVENTION

The present invention generally comprises a method for making metal alloy foils. More particularly, the invention comprises a method for making metal alloy foils, such as Ti-base, Ni-base, Nb-base and Al-Si foils, directly from metal alloy powder.

BACKGROUND OF THE INVENTION

It is well-known in the metallurgical arts that the formation of metal foils using current methods is a complex, multi-step process typically involving various combinations of hot-working, cold-working, annealing and surface finishing. Foils are most frequently formed by a series of hot-rolling or cold-rolling steps, or some combination of both, on a previously formed metal sheet, the metal sheet itself resulting from prior forming operations performed on even larger bodies such as plates,slabs or billets, or in some cases from the output of a continuous casting process. The formation of metal foils from the class of alloys suitable for high temperature, high strength applications, such as Ti-base, Ni-base, Nb-base superalloys, is known to be particularly difficult and thus expensive, because of the elaborate processes required to produce these foils as described briefly below.

One related art method by which foils have been formed from some Ti-base alloys is by hot-working a sheet of the alloy to reduce the thickness, followed by surface grinding the sheet to a thinner dimension, followed still by chemical milling to achieve a final foil thickness. This method is limited in that it is very expensive due to the substantial material loss during the various processing steps, in addition to the costs associated with the processing steps themselves. Also, to the extent that the hot-working steps of this process may cause grain growth and/or grain texturing within the sheet, such features are frequently undesirable.

A second related art method of forming foils of Ti-base alloys, such as titanium aluminide, involves plasma spraying a pre-foil using alloy powder. The pre-foil is subsequently processed by steps such as roll consolidation, cold-rolling and annealing to form a foil having a typical thickness of about 0.003 in. This method also has several inherent limitations. One limitation is that the pre-foils formed by spray forming are not fully dense (i.e. near theoretical density) in that microscopic examination of them reveals internal porosity, such that additional consolidation is typically required. A second limitation is the strong propensity for many reactive alloys such as Ti-base alloys, to absorb oxygen, nitrogen or other contaminants during the plasma spray process used to form the pre-foil, even when the deposition is done in an an evacuated chamber which has been backfilled with argon. For example, Applicants have observed that an alloy powder of Ti-6Al-2Sn-4Zr-2Mo, with measured average oxygen and nitrogen levels of approximately 850 ppm O and 100 ppm N, produces an RF plasma-sprayed pre-foil having measured average levels of these elements of approximately 1950 ppm O and 140 ppm N. Similarly, in a Ti-14Al-21Nb alloy, Applicants measured average concentrations of oxygen and nitrogen of approximately 800 ppm O and 80 ppm N in the powder, as compared to average concentrations of 1350 ppm O and 160 ppm N in a pre-foil made from the same powder by plasma spraying.

A third related art method for forming metal alloy foils is described in U.S. Pat. No. 4,917,858. This patent describes a method for making titanium aluminide alloy foils by blending powders of elemental titanium and elemental aluminum in preselected proportions corresponding to desired Ti-Al alloy compositions. The blended elemental powders are hot-rolled at approximately 700° C. to form a "green" foil having a thickness of 0.004–0.40 inches. The green foil is then sintered at 500°–1200° C. to form a foil having less than theoretical density. The sintered foil is then hot pressed at 800°–1200° C. to produce a finished foil having theoretical density. This patent also discloses the use of a third powder with the titanium and aluminum powders as an alloying element and lists niobium, molybdenum, vanadium, chromium, manganese, erbium, and yttrium as candidate third powder additives. However, this process requires at least three high temperature process steps which, due to the expense required to perform them, are known in the art to add significant cost to the final foil product. In addition, it is known that hot-rolling generally causes some degree of grain texturing or grain orientation, as well as having the potential to induce grain growth.

SUMMARY OF THE INVENTION

The present invention comprises a method for making metal alloy foils directly from powder, and as such is simplified, requiring generally fewer process steps than related art methods for making foils. This method is believed to be applicable to metal alloys generally, but particularly useful for making foils from high melting point alloys, such as for example Ti-base, Ni-base, Nb-base alloys, and lower melting point alloys such as Al-Si. Further, this method produces foils which in many cases are fine-grained, exhibiting sufficient ductility at both ambient and high temperatures to permit subsequent forming operations, particularly cold-rolling.

The method comprises the steps of: selecting a metal alloy powder; loading the metal alloy powder into a means for holding; evacuating the means for holding; hot pressing the means for holding to form a metal alloy foil directly from the metal alloy powder; and removing the means for holding from the metal alloy foil.

The method further may comprise the step of forming the metal alloy foil following the step of removing the means for holding.

One object of the method of the present invention is to provide a method of making metal alloy foils directly from metal alloy powders, thereby avoiding numerous process steps associated with related art methods of making metal alloy foils, and serving as an improvement to them.

A second object of the invention is to provide a method of making metal alloy foils which are substantially free of oxygen and nitrogen contaminants.

A third object of the invention is to provide a method of making metal alloy foils which are substantially free of forming (e.g. rolling) induced grain texturing.

A fourth object of the invention is to provide a method of making fine-grained, ductile metal alloy foils.

A fifth object of the invention is to provide a method of making metal alloy foils which have variable alloy compositions.

The ductility of many of the foil compositions which can be made by this method is a significant unexpected advantage because ductile metal foils have been made using this method from metal alloys which are known to be brittle in other forms, such as Al-Si alloys. This advantage is related in large part to the fine grain size and phase size/distribution of metal alloy foils which are made by this method and it makes possible subsequent metal working operations such as cold-rolling. Therefore, extremely thin foils are possible of alloy compositions that were heretofore either not possible to make in foil form, or prohibitively expensive.

The ability to vary alloy composition within a single foil is also a significant feature of the method of this invention, and is believed by Applicants to offer many unexpected advantages over related art methods of making foils in that significant alteration of mechanical, physical, chemical and other foil properties can be made within a single foil.

DETAILED DESCRIPTION OF THE INVENTION

The present invention comprises a method of making metal alloy foils directly from powder in a manner which is greatly simplified with respect to related art methods, in that it generally requires fewer process steps to produce a finished foil. Foils produced by this method are also characterized by being fine-grained, substantially free of atmospheric contaminants such as oxygen and nitrogen, as well as by being substantially free of deformation induced grain texturing or orientation. The method has been demonstrated on a wide variety of metal alloys, and Applicants believe the method to be generally applicable for utilization to produce metal alloy foils.

A foil is defined in *A Concise Encyclopedia of Metallurgy,* by A. D. Merriman, MacDonald and Evans LTD. 1965 as a very thin sheet of metal with no standard thickness, but in general usage is regarded as being intermediate in thickness between "leaf" and "sheet" materials. *A Glossary of Metallurgical Terms and Engineering Tables,* published by The American Society for Metals in 1983 defines a foil as "a metal in sheet form less than 0.15 mm (0.006 inches) in thickness." As used herein, the term "foil" designates a thin layer of metal having a thickness range of about 0.005–0.017 inches in the as-hot-pressed condition as further described herein, except that thicker sheets of material should be included within this definition to the extent that the method of making described herein can be utilized to produce ductile forms of alloys such that they may be formed to a thickness within the range described above and likewise thinner foils should be included within this definition to the extent that they are subsequently formed from foils initially falling within this range.

Figure 1:
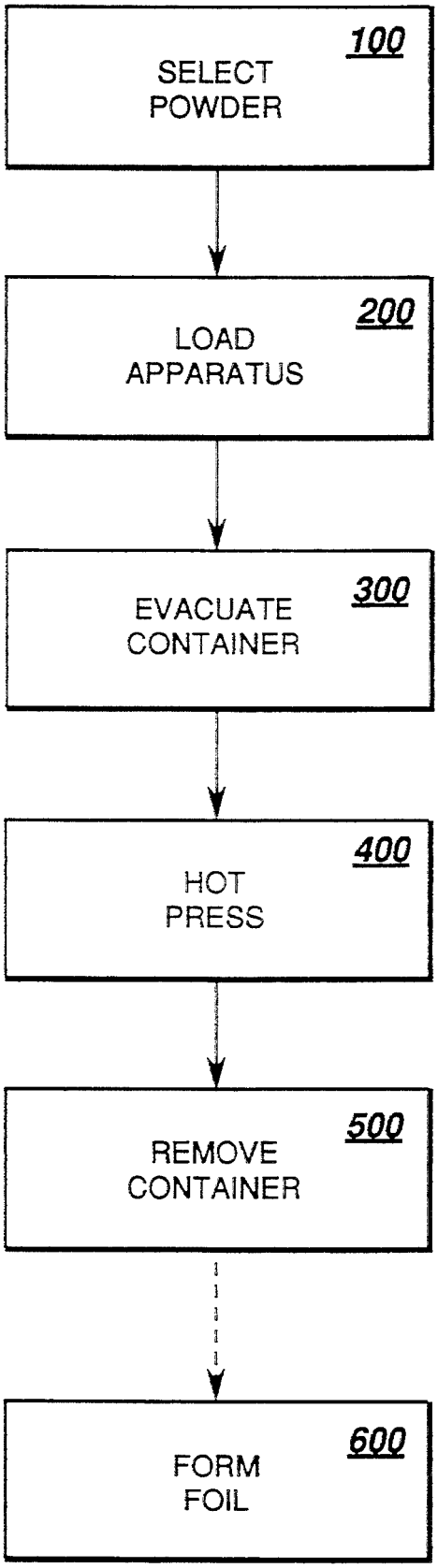
FIG. 1 is a flow diagram describing the steps of the method of the present invention and their sequence.

Referring now to FIG. 1, the method comprises the steps of: selecting the powder 100; loading the powder 200 into a means for holding the powder which is adapted to be compressed; evacuating the means for holding 300; hot pressing 400 the powder contained within the means for holding to form a metal alloy foil directly from the powder; and removing 500 the metal alloy foil from the means for holding.

Further, the method may also comprise the step of evacuating 300 the means for holding prior to hot pressing 400, particularly for alloys that are susceptible to reaction with atmospheric constituents, particularly oxygen and nitrogen.

The method may also comprise the step of forming 600 metal alloy foils created by the method to reduce their thickness following the step of removing the means for holding 500.

The step of selecting the powder 100 requires consideration of the desired composition and properties of the finished foil. Powders may be selected from the group consisting of pure metal powders, admixtures of pure metal powders, admixtures of pure metal powders and alloy powders, alloy powders, and admixtures of alloy powders. One example of the method of the invention which utilizes a mixture of two pure metal powders having relatively higher and lower melting temperatures is described in co-pending patent application referenced above as Ser. No. 08-194,967. The factors to be considered in the selection, particularly as to whether to use mixtures of pure metal powders, alloy powders or a combination thereof, are known to those of ordinary skill in the metallurgical arts and include: relative thermodynamic and kinetic properties of the powder constituents, such as phase relationships, equilibria considerations, relative diffusivities and relative melting temperatures of the powders; desired foil morphologies; desired foil mechanical properties and other considerations. Applicants believe that a preferred embodiment for many alloys will be selection of an alloy powder (a powder wherein the alloying constituents have already been combined) because, at a given temperature, such a selection will speed up the generally desirable process of homogenization as compared with the time required to homogenize admixtures of pure metal powders, and because it will thus in many cases reduce the tendency for grain growth and produce a finer grain size in the resulting foil. Also, the step of selecting 100 must consider variables known to those of ordinary skill which are associated with the powder, including: powder size range and size distribution, powder particle shape, particle grain size and morphology and other factors. Preferred embodiments of selecting 100 alloy powder to make metal alloy foils representing a plurality of alloy compositions are shown in Table 1. As shown in the data of Table 1 and Table 2, Applicants have demonstrated the selection of Ti-base, Ni-base, Nb-base and Al-Si alloy powders. In these preferred embodiments, the particle size of the selected powders ranged from −80 to +325 mesh, but a range of about −140 to +270 mesh is preferred. If the powder particles are too small, the flowability of the powder into the means for holding is inhibited. If the powder particles are too large, the packing density of the powder is reduced and the grain size of the resultant foil may be such that on average, the foil thickness comprises a very small number of grains through the thickness of the foil. Large grained foils are generally thought to be undesirable in that they offer less resistance to crack propagation through the thickness of the foil than do fine-grained foils. Powder surface roughness and shape are also important factors affecting the flowability of the powder. Generally, smoother and more regularly shaped (e.g. more spherical) powder particles improve the flowability.

Figure 5:
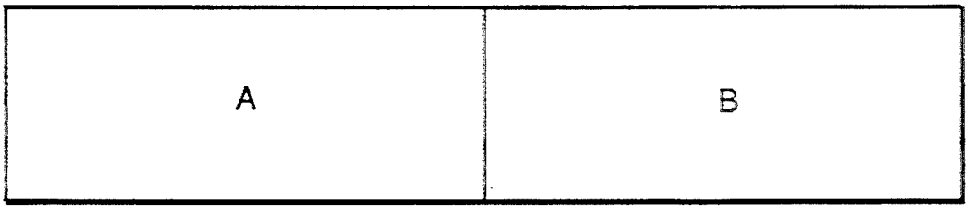
FIG. 5 is a schematic top view representation of an embodiment of a foil having variable properties.
Figure 6:
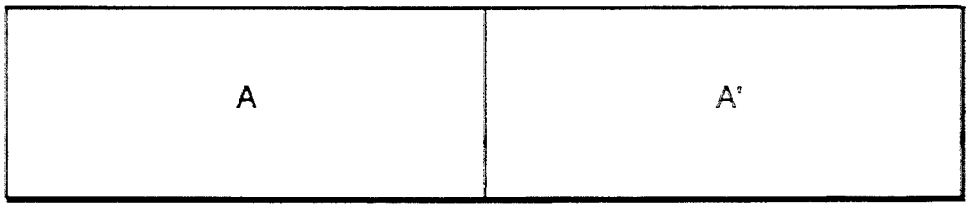
FIG. 6 is a schematic top view representation of a second embodiment of a foil having variable properties.

Referring now to FIGS. 5 and 6, the step of selecting 100 may also comprise choosing powders so as to substantially vary the alloy composition and properties within certain regions of the resulting foil. For example, referring to FIG. 5, the powders could be selected and placed within the means for holding so as to produce a foil with a plurality of different alloy compositions, as illustrated by regions of A-base and B-base alloy, where A and B are different elements. Alternatively, referring to FIG. 6, the powders could be selected such that they are both A-base, but with different compositions represented by A and A'. The variations noted are not exhaustive, but rather only illustrative of the principle that any property of a resultant foil that can be altered by powder selection, can form the basis for selecting 100 the powder so as to produce a nonhomogeneous foil having any variety of nonhomogenieties, and thus widely varying physical, mechanical, electrical, chemical, morphological or other properties. The only requirement in making such variations, is that the powder variations selected are compatible so as to produce useful foils wherein the regions having differing properties are compatible with one another. For example, for foils made from two different alloys, it may be desirable to provide a transition zone of a third alloy, or a blend of the two alloys, between the two alloys.

Selecting 100 also may comprise choosing powder which is substantially free of oxygen and nitrogen. In this context, "substantially oxygen and nitrogen free" means selecting commercially available powders which have controlled levels of these constituents which are as low as commercially possible in powder form, except in cases where these constituents are considered to be part of the desired alloy composition (e.g. oxide dispersion-strengthened alloys). Applicants have determined that foils made by the method of the invention have about the same concentration of oxygen and nitrogen as found in the powder used to make them, therefore, such a selection is intended to produce foils with reduced levels of these constituents as distinguished from foils made using related art methods as described above (e.g. spray forming of the same powder).

Figure 2:
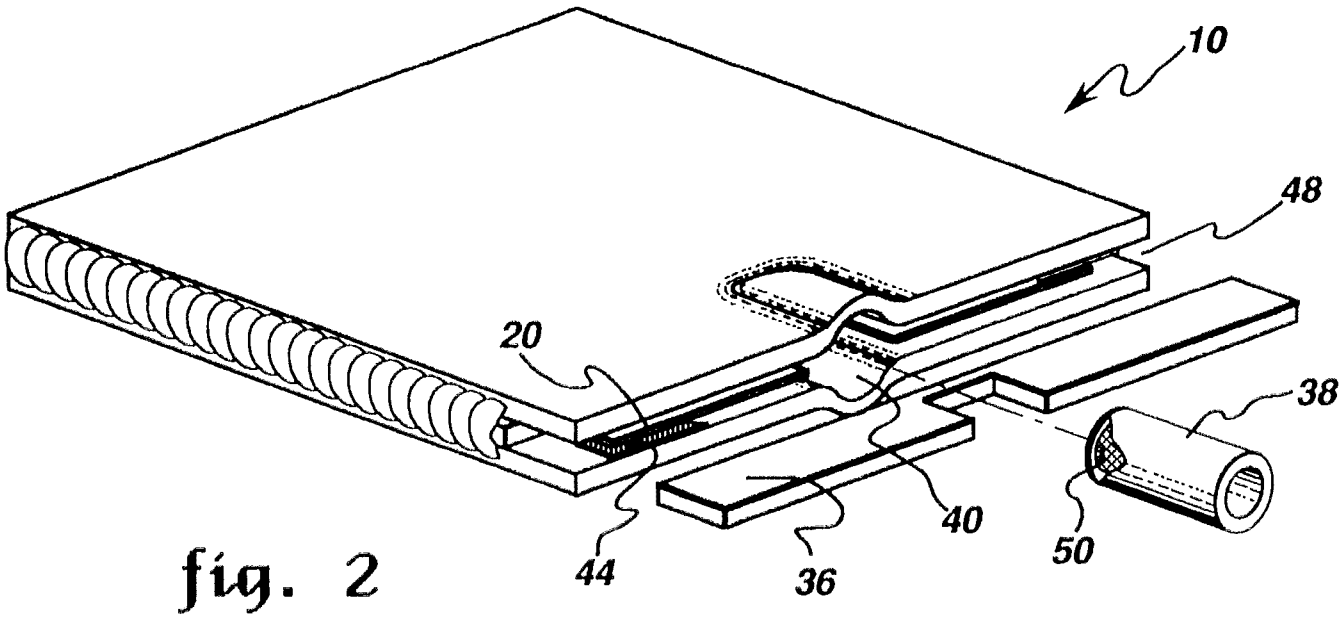
FIG. 2 is a perspective view of a partially assembled apparatus with several exploded elements, illustrating how the apparatus is incorporated in the method of the invention.
Figure 3:
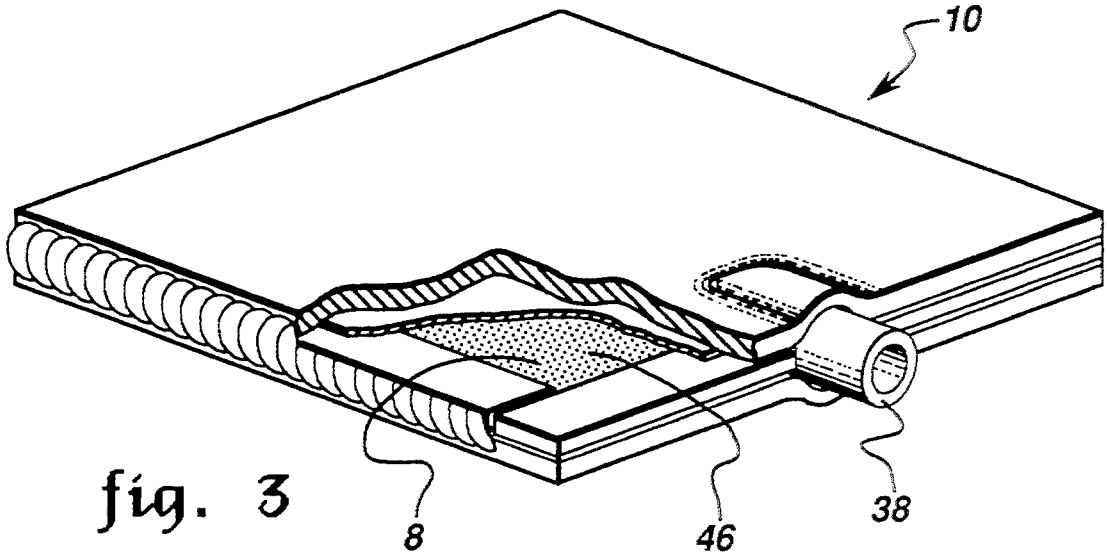
FIG. 3 is a view of the apparatus of FIG. 2 illustrating how the exploded elements of FIG. 2 are assembled into the apparatus.

Referring now to FIGS. 2 and 3, after the step of selecting 100, the step of loading 200 a powder 8 into a means for holding such as apparatus 10 is accomplished. Means for holding, such as apparatus 10, is described in detail in co-pending application Ser. No. 08/223,347. The essential characteristic of the means for holding is that it must define a cavity having the near-net shape of a foil. This requires that the means for holding have a thickness to allow for densification of the metal alloy powder, as described in greater detail below, to a thickness in the range set forth herein, regardless of the shape of the cavity defined (e.g. flat planar, hemi-spherical, etc.). Loading 200 is partially illustrated in FIGS. 2, 3 and 4. Referring to FIG. 2, in a preferred embodiment loading 200 is done by placing apparatus 10 upright with opening 48 into cavity 46 oriented vertically (not shown), so that the selected powder can be poured into cavity 46.

TABLE 1

ALLOY POWDER COMPOSITIONS AND HOT PRESSING CONDITIONS

| Composition (wt/%) | Powder Size Range (mesh) | HIP Conditions |
|---|---|---|
| Ti—6Al—2Sn—4Zr—2Mo | −140 | 1650° F./3 hr/15 ksi |
| Ti—14Al—21Nb | −140 | 1830° F./1.5 hr/15 ksi |
| Ti—11Al—45Nb | −80 + 140 | 1920° F./4 hr/15 ksi |
| Rene'142 (composition only) | −80 + 140 | 2190° F./4 hr/15 ksi |
| Rene'N4 (composition only) | −140 | 2190° F./4 hr/15 ksi |
| Ni—27Co—16Cr—8Al—6W—0.2Y | −200 + 270 | 1920° F./4 hr/15 ksi |
| Ni—22Cr—10Al—0.8Y | −140 + 270 | 2010° F./4 hr/15 ksi |
| Co—32Ni—21-Cr—8Al—0.5Y | −170 + 325 | 2010° F./4 hr/15 ksi |
| Fe—20Cr—4.5Al—0.5Y | −140 + 270 | 2010° F./4 hr/15 ksi |
| MA754 (composition only) | −80 + 140 | 2190° F./4 hr/15 ksi |
| Ni—18Al—23Fe | −140 | 2190° F./3 hr/15 ksi |
| Ni—9Co—8Cr—6Al—5Zr—1.2B | −140 + 270 | 2010° F./4 hr/15 ksi |
| Ni—43Pd—7.5C0—7Cr—5Al—1.4B | −140 + 270 | 2010° F./4 hr/15 ksi |
| Ni—60Al—1B | −120 + 325 | 1605° F./3 hr/15 ksi |
| Ni—36Ti—1B | −120 + 325 | 1830° F./3 hr/15 ksi |
| Nb—26Ti—3Al—6Cr—1.5V—5Hf | −80 + 140 | 2010° F./4 hr/15 ksi |
| Al—11.6Si | −140 + 325 | 1065° F./3 hr/15 ksi |
| (Al—11.6Si) + 25 vol %Si | −140 + 325 | 1065° F./4 hr/15 ksi |
| Si | −270 + 325 | |
| Al—25Si | −100 | 1065° F./1 hr/15 ksi |

In a preferred embodiment, pouring is assisted by the use of a funnel or similar device. As powder 8 is poured into apparatus 10, packing may be assisted by any number of suitable means including mechanical vibration of the can, mechanical compaction or any other means for assisting the packing of the powder.

TABLE 2

TENSILE PROPERTIES OF POWDER FOIL MATERIAL

| Composition | Test Temp. °F. | 0.2% Y.S. (ksi) | U.T.S. (ksi) | Elongation (%) |
|---|---|---|---|---|
| Rene 'N4 (composition only) | 70 | 138 | 202 | 13.1 |
| | 1600 | 78 | 79 | 0.3 |
| | 1800 | 22 | 34 | 2.5 |
| Rene '142 (composition only) | 70 | 124 | 181 | 10.8 |
| | 1400 | 122 | 148 | 5.7 |
| | 1600 | 102 | 113 | 1.3 |
| | 1800 | 44 | 45 | 0.4 |
| Ni—22Cr—10Al—0.8Y | 70 | 125 | 171 | 12.3 |
| | 1830 | 11 | 13 | 10.1 |
| Ni—27Co—16-Cr—8Al—6W—0.2Y | 70 | 116 | 165 | 13.3 |
| | 1830 | 8 | 9 | 155 |
| Fe—20Cr—4.-5Al—0.5Y | 70 | 62 | 85 | 18.9 |
| | 1400 | 8 | 11 | 72.8 |
| | 1600 | 5 | 6 | 115 |
| | 1800 | 4 | 4 | 53.9 |
| Co—32Ni—21-Cr—8Al—0.5Y | 70 | 115 | 142 | 3.7 |
| | 1830 | 7 | 9 | 34.2 |
| MA754 (composition only) | 70 | 147 | 149 | 0.6 |
| | 1830 | 7 | 9 | 43.6 |

TABLE 2-continued

TENSILE PROPERTIES OF POWDER FOIL MATERIAL

| Composition | Test Temp. °F. | 0.2% Y.S. (ksi) | U.T.S. (ksi) | Elongation (%) |
|---|---|---|---|---|
| Al—11.6Si | 70 | 14 | 20 | 27.1 |

Figure 4:
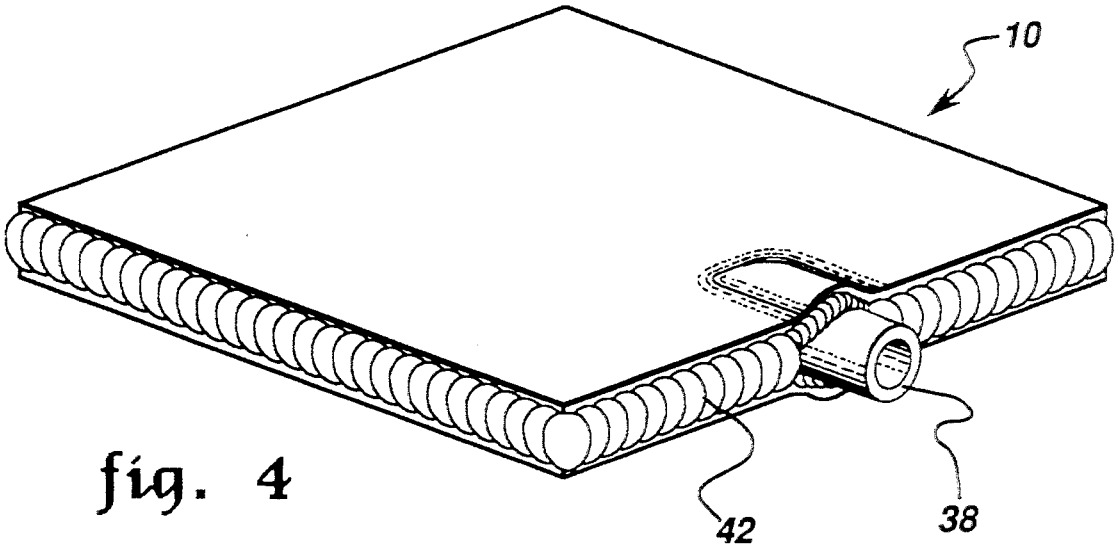
FIG. 4 is a view of the apparatus of FIG. 3 illustrating how the apparatus is sealed.

In a preferred embodiment, a mechanical ram in the form of a thin sheet is used to pack the powder 8 into apparatus 10. Referring now to FIG. 3, after filling cavity 46, shim 36 is inserted to close opening 48, and tube 38 is inserted into orifice 40 and seated against shim 36. Referring now to FIG. 4, the end of apparatus 10 into which shim 36 and tube 38 are inserted is sealed, such as by weld 42 around the outer edge of apparatus 10.

Evacuating 300 of apparatus 10 may be accomplished by drawing a vacuum through tube 38, which has a tube screen 50 attached on the end enclosed within apparatus 10. Screen 50 has a mesh size sufficiently small to prevent the escape of powder 8 during evacuation of cavity 46. Tube 38 may then be sealed using any suitable means, which in a preferred embodiment comprised mechanically crimping tube 38 while it is heated followed by TIG welding of the crimped end. Applicants have further observed that it is preferred to include in the construction of apparatus 10, internal airways such as by means of screen 44 in order to make provision for the evacuation of air from behind means for inhibiting interdiffusion 20 (if one is used) at the same time that cavity 46 is evacuated. Evacuation of this area expands the thickness of cavity 46 slightly as well as making the thickness of cavity 46 more uniform throughout, which results in foils having greater uniformity in thickness.

The loaded apparatus 10 is then subjected to the step of hot pressing 400 for a time and at a temperature and pressure sufficient to densify the metal alloy powder of interest, generally to nearly theoretical density. The time/temperature/pressure conditions for a number of preferred embodiments of different alloy types are given in Table 1. The degree of densification may be varied if desirable in light of the desired end-use of the foil and planned subsequent processing steps such as mechanical deformation or heat treating, and should not be considered as limiting the method of the invention. Full densification is not essential. The time, temperature and pressure conditions for hot pressing will necessarily vary depending on the alloy composition and characteristics of the powder including their melting point(s) powder type, particle size(s) and packing density. Exemplary conditions are provided in Table 1 for a plurality of alloys comprising a range of the characteristics described above.

Hot pressing may be accomplished by any suitable means including hot isostatic pressing (HIP), vacuum hot pressing (VHP), certain types of forging or other suitable means. In the context of this invention, the term "hot pressing" primarily refers to the application of pressure and heat to the means for holding, not to any particular means of their application. While in the preferred embodiments described herein, HIP was used to apply heat and pressure simultaneously, this may not be required. For instance, it may be desirable to apply pressure to compact the powder followed by a separate step of heating to sinter the powder particles. Conversely, it may also be desirable for some alloys to sinter, or partially sinter the powder particles followed by application of pressure to densify the foil.

Following the step of hot pressing 400 is the step of removing 500 the foil from the means for holding or container. This may be accomplished by any suitable means, and will depend significantly on the construction of the means for holding as well as the composition of the metal foil. In a preferred embodiment, where the means for holding is a cold-rolled steel container with a molybdenum foil diffusion inhibiting inner liner, a preferred method of removing 500 comprises dissolving the means for holding with the use of an acid etchant comprising a solution of 50% nitric acid/50% water by volume. Applicants have also observed that some interaction of the metal alloy foil with the means for inhibiting interdiffusion is possible with some alloy combinations depending on the hot pressing conditions utilized, such as would be recognized by those of ordinary skill. In such cases different diffusion inhibiting materials may be used, or the region of interaction (e.g. typically the outer surfaces of the foil) may be removed by etching or other suitable means.

After a foil is removed from the means for holding, and depending on the end-use for which it is intended, the foil may be used in the as-pressed condition, or may be subjected to subsequent forming operations, heat treating operations, or combinations of these operations for any of a combination of purposes including forming to a final shape, thickness reduction or uniformity improvement, grain size modification, cladding, surface finishing or other purposes. Forming operations may include any suitable forming operations including cold-rolling, cold forming (e.g. stamping), hot-rolling, forging or combinations of these or other forming operations. The forming operations available for use on a particular foil will depend principally on the ductility of the resulting foil which varies depending on several factors including the composition of the alloy, grain size, phase size/distribution, and hot pressing conditions utilized, as illustrated by the ductility and mechanical data set forth in Table 2. A significant advantage and unexpected result of this method of making metal alloy foils is that it yield metal alloy foils that are fine-grained as shown in Table 3, and that many of the metal alloy foils, including the Ti-base, Ni-base and Al-Si foils exhibit significant ductility at ambient temperature (e.g. about 70° F.), as shown in Table 2. Hence, the as-pressed foils in many cases can be easily reduced in thickness, for example from an as-pressed thickness of about 0.010 in. down to 0.005 in. or lower, using conventional cold-rolling, or a combination of cold-rolling and annealing.

TABLE 3

Grain Sizes of Selected Powder Foils

| Composition (wt/%) | Powder Size Range (microns) | Grain Size (microns) |
|---|---|---|
| Ti—1421 | <105 | ≦10 |
| Al—11.6 Si | <105, >44 | ≦10 (Al grains),2-5 (Si grains) |
| Ni—27Co—16Cr—8Al—6-W—0.2Y | <74, >53 | ~5 |
| MA754 | <177, >105 | 1-2 |
| Rene'142 | <177, >105 | ~30 |
| Rene'N4 | <105 | ~20 |

Another significant advantage and unexpected result is that the method of the invention produces foils which can be used directly, and without subsequent forming operations. Thus, it is possible to produce metal alloy foils which are substantially free from forming induced grain texturing or orientation. These defects are known to exist in metal alloy foils made using related art foil-making methods, particularly those methods which require forming operations such as hot-rolling or cold-rolling.

EXAMPLE 1

The method of making several Ti-base alloy foils is described below as an example of the method of the invention. The means for holding was a steel HIP can described in Example 1 of the co-pending patent application Ser. No. 08/233,347, referenced above. The alloy powders selected in this example were: Ti-6Al-2Sn-4Zr-2Mo (in weight-percent), an alpha+beta alloy (Ti-6242); Ti-14Al-21Nb (in weight-percent), an alpha-2 ($Ti_3Al$) alloy (Ti-1421); and Ti-11Al-45Nb (in weight-percent), an orthorhombic ($Ti_2AlNb$) alloy (Ti-1145); which in light of the data presented above for these Ti 6242 and Ti-1421 powders would be considered in the context of this application to be substantially oxygen and nitrogen free. Powder sizes for these alloys are shown in Table 1. The powders used were plasma-rotating electrode powders (PREP) purchased from Nuclear Metals, Inc. and from Crucible Research. No effort was made to optimize powder particle sizes for the powders used in this example.

In order to load the HIP can, Mo foil sleeves were flared into funnels and inserted into the openings in the HIP cans, and the HIP cans were placed upright in an ultrasonic cleaner. Powder was then loaded into the cans through the funnels. During loading, the HIP cans were vibrated ultrasonically, and a thin sheet was used as a mechanical ram to pack the powders. After loading, the Mo sleeves were removed and the HIP cans were completed by sealing the openings as described above. The assembly was then evacuated and leak-tested, and the evacuated assemblies were baked out under vacuum for 24 hours at 200° C. The steel tubes were then heated, crimped, cut-off and sealed, by TIG welding the cut end.

HIP was done in an argon atmosphere under the time, temperature pressure conditions listed in Table 1. With a cavity thickness of about 0.015 in., the average thickness of the resulting foils was about 0.010–0.011 in., with a range in thickness of 0.009– 0.013 in. The resulting foils generally had fine grained microstructures. For example, the grain size of the Ti-1421 was less than or equal to 10 microns.

Cold-rolling of the Ti-6242 and Ti-1421 foils was done by packing the foils between stainless steel sheets which were approximately 0.022–0.025" thick. The average amount of reduction per pass for both the Ti-6242 and Ti-1421 foils was ~5%. After each pass, the thickness, length and width of the foils were measured, and the edges and surfaces of the foils were examined visually for cracking. The Ti-6242 foil could be cold-rolled approximately 40–45% without substantial edge cracking or observable tearing within the bulk foil. Sheets of this alloy made by wrought processing would be expected to be cold-rolled to about 15%. After 40–45% deformation, the Ti-6242 foil was stress-relief-annealed for 1 hour at 600° C. in dry argon, and the combination of cold-rolling and annealing was repeated until the foil was about 0.001" thick.

For the Ti-1421 foil, no significant cracking was observed after 10% cold-rolling, while further rolling to ~20% resulted in edge cracking, as well as cracks or tears in the bulk material. Repeated cycles of ~10% cold-rolling plus a stress-relief anneal may allow successful reduction of 0.010" foil to reduced thicknesses. For both the Ti-6242 and Ti-1421 foils, the cold-rolling decreased considerably the variation in thickness measured in the as-HIP foil.

This description and example are intended only to be descriptive of the embodiments set forth herein, and should not be construed as limiting the invention to the embodiments set forth herein.

What is claimed is:

1. A method of making a metal alloy foil, comprising the steps of:

selecting a metal alloy powder;

loading the metal alloy powder into a means for holding;

evacuating the means for holding;

hot pressing the means for holding to form a metal alloy foil directly from the metal alloy powder;

and removing the means for holding from the metal alloy foil.

2. The method of making a metal alloy foil of claim 1, wherein the method of loading comprises a combination of mechanical compaction and vibration of the metal alloy powder.

3. The method of making a metal alloy foil of claim 1, further comprising the step of forming the metal alloy foil following the step of removing the means for holding.

4. The method of making a metal alloy foil of claim 3, wherein the step of forming comprises cold-rolling the metal alloy foil.

5. The method of making a metal alloy foil of claim 3, further comprising the step of heat treating the metal alloy foil after the step of forming.

6. The method of making a metal alloy foil of claim 5, wherein the steps of forming and heat treating are repeated at least once, except that the step of annealing after the final step of cold-rolling is optional.

7. The method of making a metal alloy foil of claim 3, wherein the step of forming the metal alloy foil comprises hot forming the metal alloy foil at a temperature $T_R$, in the range of $0.5T_M \leqq T_R < T_M$ where $T_M$ is the absolute melting point of the metal alloy foil.

8. The method of making a metal alloy foil of claim 1, wherein the metal alloy powder is from the group consisting of Ti-base alloys, Ni-base alloys, Nb-base alloys and Al/Si alloys.

9. The method of making a metal alloy foil of claim 1, wherein the means for holding the metal alloy powder comprises: means for pressing a metal alloy powder, comprising an upper pressing member and a lower pressing member, each having a pressing surface, said pressing surfaces positioned opposite one another; means for separating in touching contact with the pressing surfaces, said means for separating and the pressing surfaces together defining a cavity having a near-net shape of a foil, wherein a step of hot pressing a metal alloy powder within the cavity will yield a metal alloy foil having a thickness in the range of about 0.005–0.017 in.; and means for sealably joining said means for pressing and said means for separating.

10. The method of making a metal alloy foil of claim 9, wherein the means for pressing the metal alloy powder comprises an upper platen and a lower platen each having a flat pressing surface, wherein the pressing surfaces are located parallel to and opposite one another separated by the means for separating.

11. The method of making a metal alloy foil of claim 9, wherein the means for separating comprises a metal shim which is located between the upper platen and the lower platen and around the perimeter of each of them.

12. The method of making a metal alloy foil of claim 11, wherein the means for sealably joining comprises a weld joining the upper platen, lower platen and shim together around the perimeter of the upper platen and lower platen.

13. The method of making a metal alloy foil of claim 10, wherein the means for holding further comprises a means for inhibiting interdiffusion attached to the pressing surfaces of the upper platen and the lower platen.

14. The method of making a metal alloy foil of claim 1, wherein the step of removing the means for holding comprises chemical etching.

15. A method of forming a metal alloy foil, comprising the steps of:

selecting a metal alloy powder;

loading the metal alloy powder into a container having a cavity comprising a near-net shape for a foil;

evacuating the container;

hot pressing the container so as to densify the metal alloy powder and produce a metal alloy foil; and removing the container from the metal alloy foil.

16. The method of making a metal alloy foil of claim 15, further comprising the step of forming the metal alloy foil following the step of removing the means for holding.

17. A method of forming a metal alloy foil, comprising the steps of:

hot pressing a metal alloy powder contained within a means for holding the metal alloy powder to form a metal alloy foil having an in-plane thickness in the range of about 0.005–0.017 inches; and removing the means for holding from the metal alloy foil.

18. The method of making a metal alloy foil of claim 17, wherein the means for holding is an evacuated sealed container.

19. The method of making a metal alloy foil of claim 17, further comprising the step of forming the metal alloy foil following the step of removing the means for holding.

* * * * *